US008191879B2

(12) United States Patent
Jang

(10) Patent No.: US 8,191,879 B2
(45) Date of Patent: Jun. 5, 2012

(54) VISE PADS FOR ACCURATE WORK PIECE ALIGNMENT

(76) Inventor: Man Sung Jang, Siheung Si (KR)

( * ) Notice: Subject to any disclaimer, the term of this patent is extended or adjusted under 35 U.S.C. 154(b) by 84 days.

(21) Appl. No.: 12/807,616

(22) Filed: Sep. 9, 2010

(65) Prior Publication Data

US 2012/0061897 A1 Mar. 15, 2012

(51) Int. Cl.
*B25B 5/16* (2006.01)
*B25B 1/20* (2006.01)

(52) U.S. Cl. ..... 269/257; 269/43; 269/45

(58) Field of Classification Search ..... 269/136, 269/138, 43, 45, 271, 291, 900; 29/281.1
See application file for complete search history.

(56) References Cited

U.S. PATENT DOCUMENTS 220,342 A * 10/1879 Cheney ..... 72/460
680,859 A * 8/1901 Hassler et al. ..... 269/120
1,205,795 A * 11/1916 Sapper ..... 269/138
2,274,428 A * 2/1942 Odin ..... 269/138
3,416,784 A * 12/1968 Wermuth et al. ..... 269/136
3,514,092 A * 5/1970 Lassy ..... 269/134
3,633,900 A * 1/1972 Olson ..... 269/156
3,738,638 A * 6/1973 Lassy ..... 269/136
3,785,635 A * 1/1974 Lassy et al. ..... 269/136
3,866,898 A * 2/1975 Spengler ..... 269/138
4,251,066 A * 2/1981 Bowling ..... 269/283
4,411,415 A * 10/1983 Denaro ..... 269/134
4,928,938 A * 5/1990 Ross ..... 269/261
6,427,995 B1 * 8/2002 Steinwall ..... 269/283

* cited by examiner

*Primary Examiner* — Joseph J Hail
*Assistant Examiner* — Joel Crandall
(74) *Attorney, Agent, or Firm* — Eugene Oak

(57) ABSTRACT

The present disclosure general relates to vise pads which provide accurate alignment of work pieces in a vise. The movement of internal members of these pads eliminates the need for manual adjustment such as with the use of a hammer to ensure alignment. The vise pads include wedge bars in combination with connectors which reduce friction and thus provide for longer life and efficient operation. In another embodiment, the vise pads include elastomeric bars which act as sealant to reduce entry of dust resulting from machining of a work piece.

16 Claims, 6 Drawing Sheets

VISE PADS FOR ACCURATE WORK PIECE ALIGNMENT

FIELD OF THE INVENTION

The present disclosure generally relates to vise pads useful for accurate alignment of work pieces in a vise containing apparatus such as milling machines.

BACKGROUND OF THE INVENTION

One of ordinary skill in the art understands that performing meticulous processes and procedures on a work piece requires accurate alignment when fixing such a work piece is necessary. Conventional vises as illustrated in FIG. 1 includes a main body 1 having a vise jaw 3 (a claw for clamping a work piece), a moving element 2 having a vise jaw which corresponds to the vise jaw 3 and a screw bar 5 for transport of the moving element back and forth.

Problematically, when mounting and fixing a work piece on such a vise, the vise jaw at the moving element may clamp a work piece 6 at a slant. This results in inaccurate fixation of a work piece when parallel clamping is required. Improper clamping is caused by the clearance between the female screw of the moving element and the male screw of the screw bar. This makes it difficult to correctly mount and fix a work piece just by clamping the moving element in one step.

A vise clamp operator must therefore inspect the alignment of a work piece by determining whether the vise jaw is flush with the outer surface of a work piece before final clamping with full force. The operator typically uses a hammer to strike at the head of the vise jaw to align a work piece with test plates placed underneath the work piece. Downward hammering of the work piece against the test plates ensures parallel alignment. Only after this laborious process can an operator apply final clamping.

Such manual adjustment greatly increases processing time per work piece. The inefficiency is particularly noticeable in a mass production system in which a number of work items of the same size with the same processing item and position are processed.

Therefore, there is an unmet need for an apparatus which significantly reduces the difficulty and time required for accurate clamping of a work piece in a vise.

SUMMARY OF THE INVENTION

This and other objects of the present invention are achieved by the novel vise pads for accurately aligning work pieces. The vise pads of the present disclosure include two major outside pieces as illustrated by FIG. 3. One is internal 11 and has at least two cam grooves 11*a*, 11*b* formed lengthwise over the outer surface. At least two cam grooves 14*a*, 14*b* are also located crosswise and perpendicular to the longitudinal cam grooves. This internal member contains drilled grooves 16. The other member is external 20 and has at least two cam grooves 21*a*, 21*b* formed lengthwise over the inner surface. At least two cam grooves 24*a*, 24*b* are similarly located crosswise and perpendicular to the longitudinal cam grooves. The outer member includes drilled screw grooves 22.

At least two wedge bars 32*a*, 32*b*, 33 are held parallel to each other in the present vise pads by two or more connectors 31*a*, 31*b*. The connectors each have at least two rounded holes that the wedges bars fit through. The connectors with the wedge bars form a wedge bar-connector combination as illustrated by FIG. 4. At least two bolts are coupled to the screw grooves through the bolt grooves and maintain a coupled state of the internal and external members. The present vise pad is assembled by bring the internal member into contact with the external member such that the respective longitudinal cam grooves face together. The facing together of the pieces causes insert-gripping of the wedge bar-connector combination. Screwing of the at least two bolts through the bolt grooves secures the internal and external members with the wedge bar-connector combination to form the present vise pads.

An operator may put the respective vise pads in the vise jaws at the main body side and the moving element side. Then a work piece can be inserted between the pads and the moving element clamped with full force without manual parallel adjustment with a hammer. In the event the external element is not closely attached to the vise jaw or when the internal member is not alignment parallel, the internal member of the present vise pad slightly moves in lengthwise direction within the clearance range between the female screw of the main body and the male screw of the screw bar. This movement prevents slanting of a work piece. Mere clamping of a work piece by the moving element allows easy and accurate fixation of a work piece.

Over time however, the movement and rubbing of the wedge bars of the vise pads against the cam grooves during fixation of a work piece causes wear which reduces alignment efficiency over time. Further, the entry of metal dust and other fine foreign objects caused by sawing or other operation on a work piece can further cause wearing of the wedge bars or inefficiency of the movement of the internal member of the adjusting vise pads.

In the present vise pads, the wedge bars are held parallel to each other by two or more connectors 31*a*, 31*b*. The connectors touch the internal and external members of the vise pad but the wedge bars substantially do not in one embodiment. The wedge bars can move within the connectors which have holes through which the wedge bars fit. Compared to the wedge bars placed directly onto the entire length of the cam grooves, the wedge bars touch at the connector holes. Thus, wedge bar friction is reduced, especially if the holes of the connectors contain bearings.

Furthermore, elastomeric bars 30*a*, 30*b* may be placed in the outer cam grooves to provide a seal when the internal and external members of the vise pads are put together. This seal reduces the entry of metal dust which may result from sawing or drilling of a work piece. Such reduction of impurities prolongs the life of the present vise pads.

DETAILED DESCRIPTION OF THE INVENTION

The present disclosure is generally related to a vise pad useful for accurate work piece alignment. The present vise pad comprises an internal member 10 which has at least two cam grooves 11*a*, 11*b* formed longitudinally over the outer surface of the internal member, at least two cam grooves 14*a*, 14*b* formed crosswise and perpendicular to the at least two longitudinal cam grooves and a plurality of drilled screw grooves 16. "Internal" or "inner" refers to the side of the vise pad which faces or is nearest a mounted work piece.

The present vise pad also includes an external member 20 comprising at least two cam grooves 21*a*, 21*b* formed longitudinally over the inner surface of the external member, at least two cam grooves formed crosswise and perpendicular 24*a*, 24*b* to the at least two longitudinal cam grooves 21*a*, 21*b* and a plurality of drilled bolt grooves 22 corresponding to the plurality of screw grooves 16. "External" or "outer" refers to the side of the vise pad which is further away from the mounted work piece than the internal member which is closer to the mounted work piece.

Figure 4:
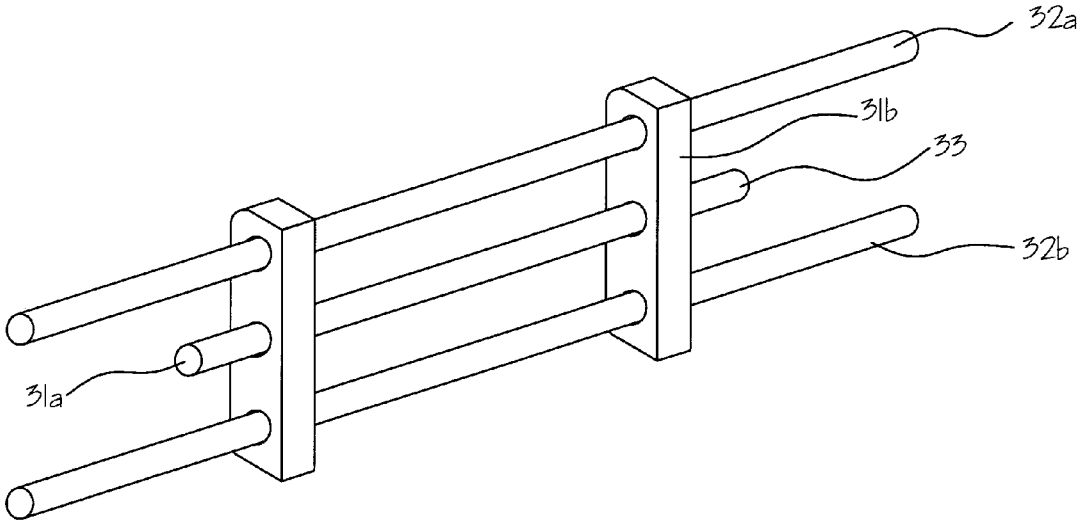
FIG. 4 illustrates a wedge bar-connector combination separated from the internal and external members.
Figure 5:
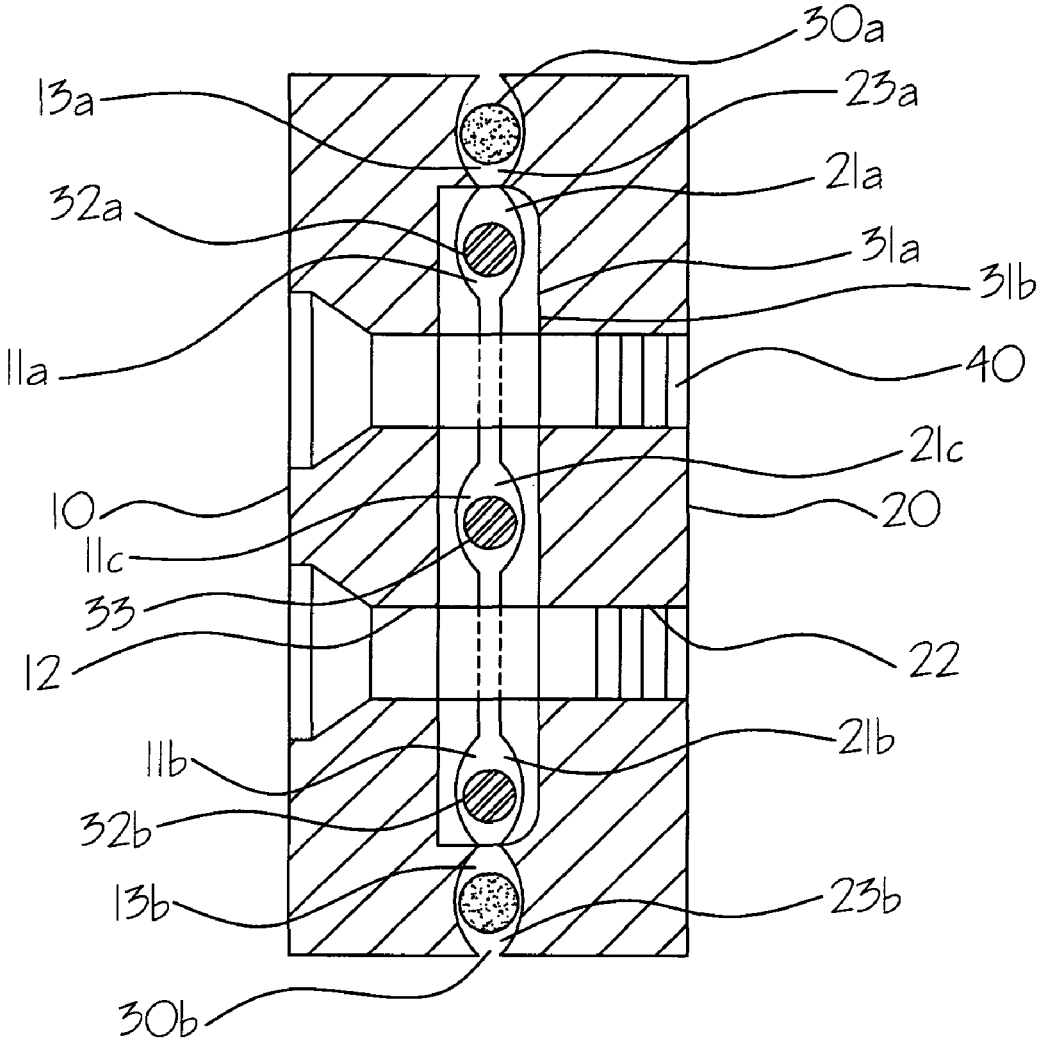
FIG. 5 illustrates a cross-sectional view of a vise pad in the assembled state.

The present vise pad further includes at least two wedge bars 32*a*, 32*b*, 33 held parallel to each other by two or more connectors 31*a*, 31*b* each having at least two rounded holes wherein the wedge bars fit through corresponding rounded holes of the connectors and forms a wedge bar-connector combination as shown by FIG. 4. At least two bolts 40 are coupled to the screw grooves through the bolt grooves to maintain a coupled state of the internal and external members. The vise pad is assembled by bringing the internal member into contact with the external member so that the respective longitudinal cam grooves face together and insert-grips the wedge bar-connector combination, and screwing the at least two bolts through the at least two bolt grooves into the at least two screw grooves.

The internal member 10 is a precisely processed thick plate of a hexahedron or parallel-piped rectangle which allows for close fixing to the outer surface of a work piece. The cam grooves 21*a*, 21*b*, 21*c* are configured to allow the internal member to move slightly in one direction within the cam grooves using a wedge bar as a mandrel. The present cam grooves have an arc shape of a partial circle. The bolt groove 16 is configured to maintain an assembled state by joining the external member 20 with a bolt and is drilled to penetrate through the plate surface of the internal member around four edges of the internal member without invading the region of the cam grooves.

The external member supports the internal member and this allows the internal member to slightly move upwardly and/or downwardly when fixing and clamping a work piece against the main body and vise jaw of the movement element of a vise. The external member also is a precisely processed thick plate of a hexahedron or rectangular which is parallel-piped for close fixation to the outer surface of the work piece. The external member is formed with longitudinal cam grooves on the same location as the cam grooves in the portion of the outer surface of the internal member. A plurality of bolts are drilled on a free space between the upper and lower cam grooves.

The screw groove is configured to maintain the assembled state of the vise pad A by inserting a bolt 40 and is drilled to penetrate through the plate surface of the external member 20 at the same location as the bolt groove 12 around four edges of the internal member 10 without invading the region of the cam grooves.

A wedge bar-connector combination (FIG. 4) is inserted between the cam grooves 14*a*, 14*b*, 24*a*, 24*b* of the internal and external members and functions as a mandrel for allowing the internal member to slight move with respect to the external member. Wedge bar is annular and the wedge bar-connector connector combination has a thickness such that the internal and external members do not contact each other.

The upward and downward movement of the internal and external members corresponds to a given clearance between the male screw and the female screw groove. The bolt 40 functions as a bar-shaped elastomer for allowing the inner member to return to the original state upon release of the clamping forces against a work piece.

Figure 1:
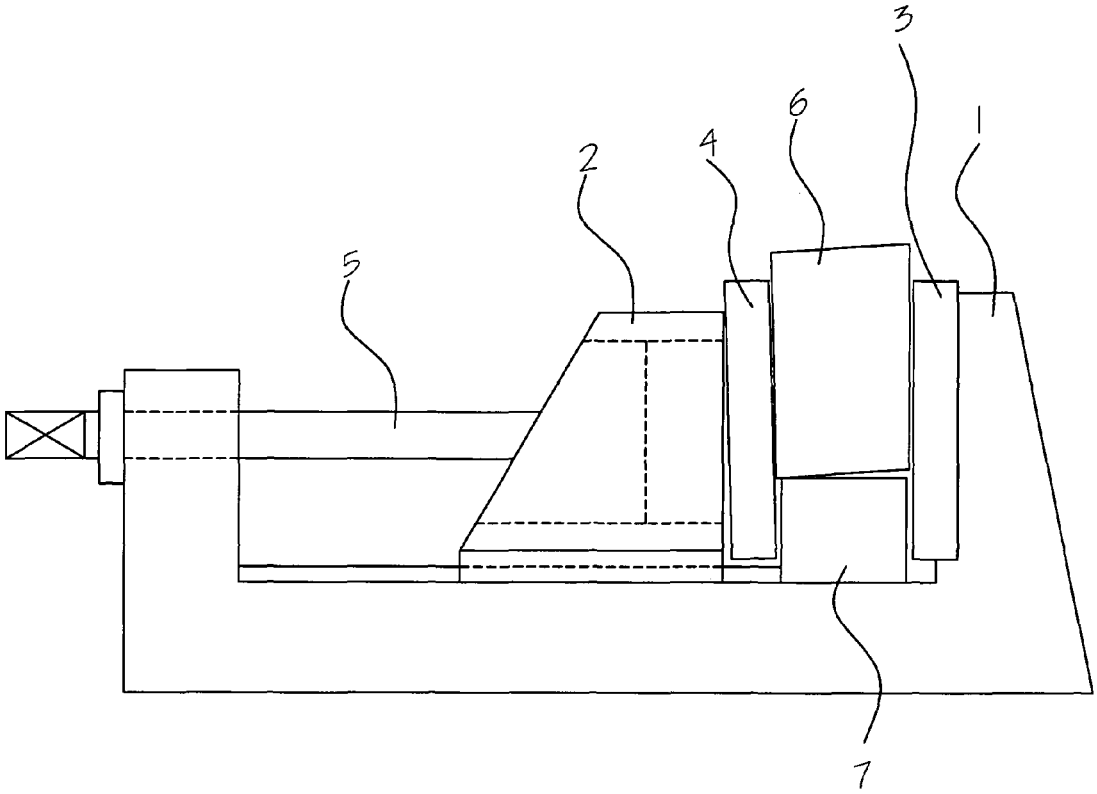
FIG. 1 illustrates a work piece incorrectly clamped in a conventional vise.
Figure 2:
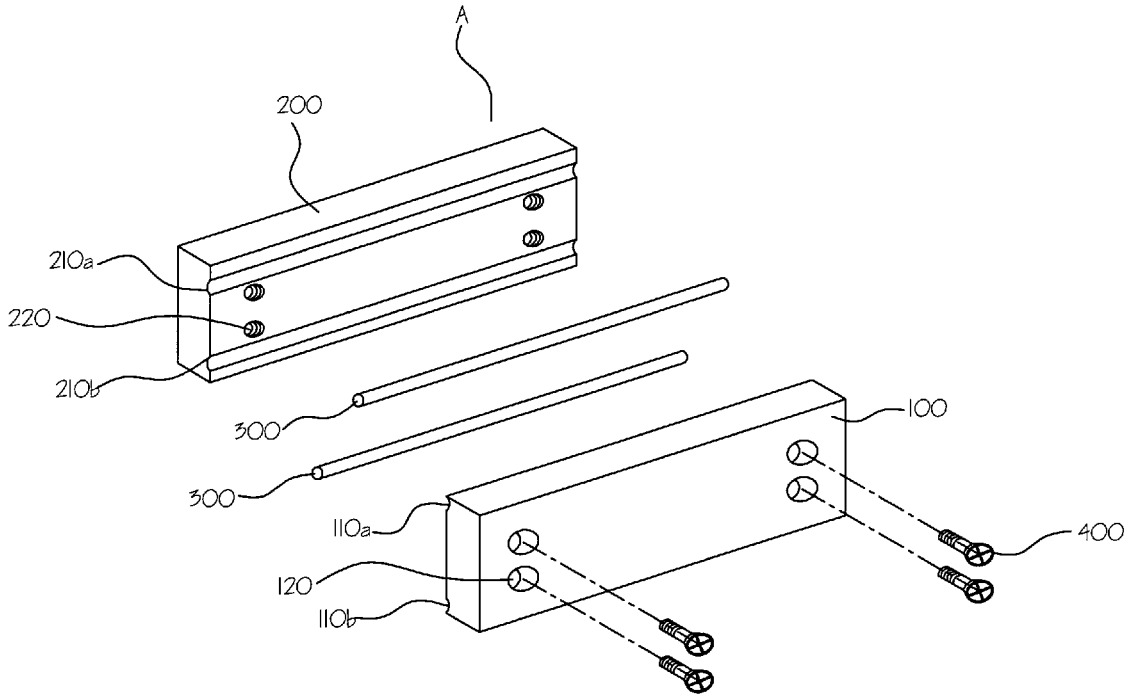
FIG. 2 illustrates a vise pad not containing a wedge bar-connector combination.
Figure 3:
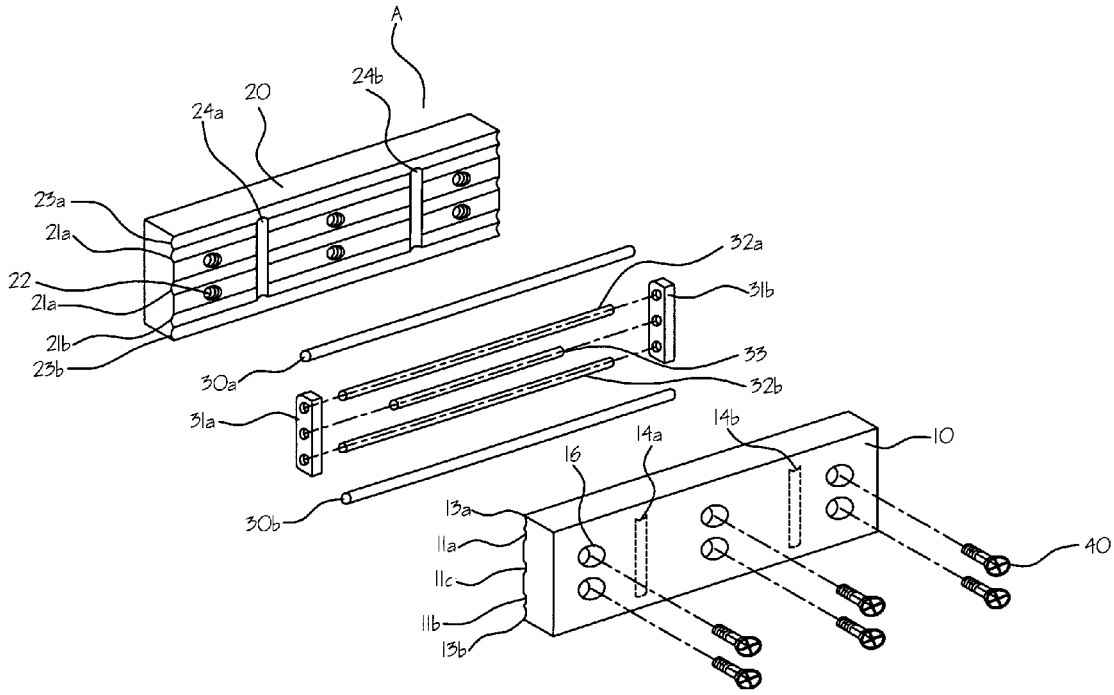
FIG. 3 illustrates an exploded view of the present vise pad having a wedge bar-connector combination and elastomeric bars.

The present vise pad as illustrated by FIG. 3 is different from the vise pad of FIG. 2. FIG. 2 shows no wedge bar-connector combination. The inner member 100 and outer member 200 has cam grooves 110*a*, 110*b*, 210*a*, 210*b*, wedge bars 300, bolt grooves 120 and screw grooves 220. The wedge bars directly contact the length of the cam grooves. In contrast, the present vise as illustrated by FIG. 3 has wedge bars that contact the inner and outer members via the connectors. Thus, friction is reduced.

Alternatively, the present wedge bar-connector combination may have at least three wedge bars held parallel to each other by two or more of the connectors. FIG. 3 illustrates an embodiment which has three wedge bars 32*a*, 32*b*, 33. The center wedge bar 33 is shorter than the outer wedge bars 32*a*, 32*b*.

In one embodiment the inner and outer members of the present vise pad are made of steel. It is within the scope and teaching of the present disclosure to include others materials which may be used to fashion the inner and outer members, especially metallic materials.

Various numbers of screws bolts may be coupled to the screw grooves through the bolt grooves. This number may be, but not limited to: two, four or six. FIG. 3 illustrates an embodiment where six bolts are used.

In one embodiment, the at least three wedge bars are in contact with the connectors but substantially not in contact with the surface of at least three cam grooves of the internal member and the surface of at least three cam grooves. Such lack of contact promotes longer life of the vise pad by reducing friction between the wedge bars and inner and external members.

Referring to the wedge bar-connector as illustrated by FIG. 4, the holes of the connector may be formed, in one embodiment, by friction reducing bearing. Such bearing will promote movement of the wedge bars through the holes and reduction of friction will result in longer life. Additionally, the combination may be lubricated with a lubricant such as an oil-based lubricant.

In another embodiment, a vise pad for accurate work piece alignment comprises an internal member 10 comprising at least five cam grooves 11*a*, 11*b*, 11*c*, 13*a*, 13*b* formed longitudinally over the outer surface of the internal member, at least two cam grooves formed crosswise and perpendicular to the at least two longitudinal cam grooves 14*a*, 14*b* and a plurality of drilled screw grooves 16; an external member 20 comprising at least five cam grooves 21*a*, 21*b*, 21*c*, 23*a*, 23*b* formed longitudinally over the inner surface of the external member, at least two cam grooves 24*a*, 24*b* formed crosswise and perpendicular to the at least five longitudinal cam grooves, and a plurality of drilled screw grooves 22 corresponding to the plurality of bolt grooves; at least three wedge bars 32*a*, 32*b*, 33 held parallel to each other by two or more connectors 31*a*, 31*b* each having at least three rounded holes wherein the wedge bars fit through corresponding rounded holes of the connectors, thereby forming a wedge bar-connector combination; at least two elastomeric bars 30*a*, 30*b* inserted between the two outermost cam grooves of the internal member and the two outermost cam grooves of the external member; at least two bolts 40 to the screw grooves 22 through the bolt grooves 12 to maintain coupled state of the internal and external members; and the pad is assembled by bringing the internal member into contact with the external member such that the respective longitudinal cam grooves face together, inserting-gripping the wedge bar-connector combination, and screwing the at least two bolts through the at least two screw grooves into the at least two bolt grooves.

The two inserted elastomeric bars provide a seal between the internal and external members while still allowing movement of these members when clamping a vise. The seal reduces entry of impurities such as metal particle dust resulting treatment of a work piece such as sawing or drilling. The elastomeric may be made of, but not limited to, silicone or rubber.

Figure 6A:
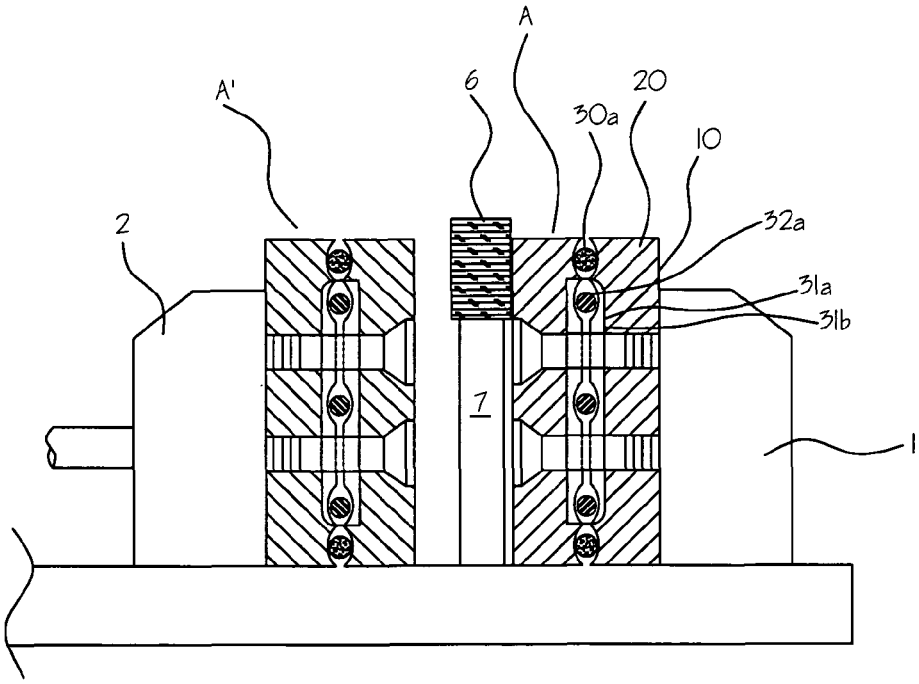
FIG. 6*a* illustrates a work piece positioned before clamping in a vise.
Figure 6B:
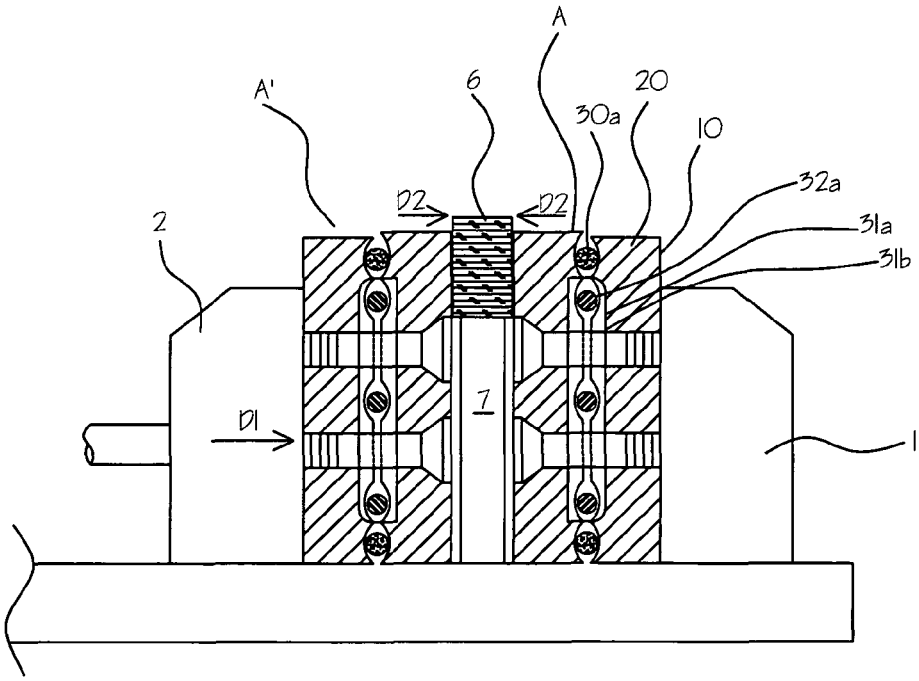
FIG. 6*b* illustrates a work-piece clamped between vise pads.

FIG. 6*a* illustrates mounting of a work piece in a vise jaw using the present vise pads. Moving element 2 is in a widened position. The vise pads A, A' are mounted on the respective vise jaw. A work piece 6 is put on a jig 7 located between the vice pads. As illustrated by FIG. 6*b*, a screw bar moves the moving element toward the main body so that the pads grip a work piece 6. The jig is a vise only jib on which a work piece is put horizontally and has its width smaller than that of the work pieces so that the pads grip the work piece without difficulty.

During initial operation a work piece may not be gripped tightly as the internal member may not be closely attached to the outer surface of the work piece. In such a case, the moving element 2 is fastened more tightly. Generally, the external element of the respective vise pads A, A' do not move. The internal member moves slightly upward within the aforementioned clearance range between the screw groove and bolt using the wedge bar-connector combination as a mandrel in accordance with a fastening pressure provided by the moving element.

When machining operation is completed for a work piece then the moving element is moved back to the returned state illustrated by FIG. 6*a*. The internal member and the wedge bar-connector combination are released from the fastening pressure applied to the work piece. The vise pads are returned to their initial positions by the repelling force that was stored when the bolt was forcibly wrenched by final clamping pressure.

Unless otherwise indicated, all numbers expressing quantities of ingredients, properties such as molecular weight, reaction conditions, and so forth used in the specification and claims are understood as being modified in all instances by the term "about." Accordingly, unless indicated to the contrary, the numerical parameters set forth in the specification and attached claims are approximations that may vary depending upon desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Grouping of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventors expect skilled artisans to employ such variations as appropriate, and the inventors intended for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Furthermore, numerous references have been made to patents and printed publications throughout this specification. Each of the above-cited references and printed publications are individually incorporated by reference in their entirety.

In closing, it is to be understood that the embodiments of the invention disclosed herein are illustrative of the principles of the present invention. Other modifications that may be employed are within the scope of the invention. Thus, by way of example, not of limitation, alternative configurations of the present invention may be utilized in accordance with the teachings herein. Accordingly, the present invention is not limited to that precisely as shown and described.

What is claimed is:

1. A vise pad for accurate work piece alignment comprising:

a) an internal member comprising at least two cam grooves formed longitudinally over the outer surface of said internal member, at least two cam grooves formed crosswise and perpendicular to said at least two longitudinal cam grooves, and a plurality of drilled screw grooves;

b) an external member comprising at least two cam grooves formed longitudinally over the inner surface of said external member, at least two cam grooves formed crosswise and perpendicular to said at least two longitudinal cam grooves, and a plurality of drilled bolt grooves corresponding to said plurality of screw grooves;

c) at least two wedge bars held parallel to each other by two or more connectors each having at least two rounded holes wherein said wedge bars fit through corresponding rounded holes of the connectors, thereby forming a wedge bar-connector combination, d) at least two bolts coupled to the screw grooves through the bolt grooves to maintain a coupled state of said internal and external members; and wherein said pad is assembled by bringing said internal member into contact with said external member such that said respective longitudinal and crosswise cam grooves face together, capturing said wedge bar-connector combination, and screwing said at least two bolts through said at least two bolt grooves into said at least two screw grooves.

2. The vise pad of claim 1, wherein at least three wedge bars are held parallel to each other by two or more said connectors thereby producing said wedge bar-connector combination.

3. The vise pad of claim 1, wherein said internal member and external member each comprises steel.

4. The vise pad of claim 1, wherein at least four bolts are coupled to the screw grooves through the bolt grooves.

5. The vise pad of claim 1, wherein said at least three wedge bars are in contact with said connectors but substantially not in contact with the surface of at least three cam grooves of the internal member and the surface of at least three cam grooves of the external member.

6. The vise pad of claim 1, wherein each rounded hole of said connectors is formed by an attached friction reducing bearing.

7. The vise pad of claim 1, wherein the wedge bars and connectors of said wedge bar-connector combination is lubricated with a lubricant.

8. The vise pad of claim 7, wherein said lubricant is an oil-based substance.

9. A vise pad for accurate work piece alignment comprising:

a) an internal member comprising at least five cam grooves formed longitudinally over the outer surface of said internal member, at least two cam grooves formed crosswise and perpendicular to said at least two longitudinal cam grooves, and a plurality of drilled screw grooves; and b) an external member comprising at least five cam grooves formed longitudinally over the inner surface of said external member, at least two cam grooves formed crosswise and perpendicular to said at least five longitudinal cam grooves, and a plurality of drilled bolt grooves corresponding to said plurality of screw grooves;

c) at least three wedge bars held parallel to each other by two or more connectors each having at least three rounded holes wherein said wedge bars fit through corresponding rounded holes of the connectors, thereby forming a wedge bar-connector combination;

d) at least two elastomeric bars inserted between the two outermost cam grooves of said internal member and the two outermost cam grooves of said external member;

e) at least two bolts coupled to the screw grooves through the bolt grooves to maintain a coupled state of said internal and external members; and wherein said pad is assembled by bringing said internal member into contact with said external member such that said respective longitudinal and crosswise cam grooves face together, capturing said wedge bar-connector combination, and screwing said at least two bolts through said at least two bolt grooves into said at least two screw grooves.

10. The vise pad of claim 9, wherein said at least two elastomeric bars comprise silicone.

11. The vise pad of claim 9, wherein said internal member and external member each comprises steel.

12. The vise pad of claim 9, wherein at least six bolts are coupled to the screw grooves through the bolt grooves.

13. The vise pad of claim 9, wherein said at least three wedge bars are in contact with said connectors but substantially not in contact with the surface of at least five transverse-type cam grooves (11*a*, 11*b*, 11*c*) of the internal member (10) and the surface of at least five transverse-type cam grooves (21*a*, 21*b*, 21*c*) of the external member (20).

14. The vise pad of claim 9, wherein each rounded hole of said connectors is formed by an attached friction reducing bearing.

15. The vise pad of claim 9, wherein the wedge bars and connectors of said wedge bar-connector combination is lubricated with a lubricant.

16. The vise pad of claim 9, wherein said lubricant is an oil-based substance.

* * * * *